US007709075B2

(12) United States Patent
Suzuki

(10) Patent No.: US 7,709,075 B2
(45) **Date of Patent: *May 4, 2010**

(54) INTERNAL MATERIAL OF SOLE, SHOE INSOLE AND BOOT

(75) Inventor: Atsushi Suzuki, Osaka (JP)

(73) Assignee: Teijin Fibers Limited, Osaka (JP)

( * ) Notice: Subject to any disclaimer, the term of this patent is extended or adjusted under 35 U.S.C. 154(b) by 545 days.

This patent is subject to a terminal disclaimer.

(21) Appl. No.: 11/632,165

(22) PCT Filed: Jun. 29, 2005

(86) PCT No.: PCT/JP2005/012438

§ 371 (c)(1),
(2), (4) Date: Jan. 11, 2007

(87) PCT Pub. No.: WO2006/006454

PCT Pub. Date: Jan. 19, 2006

(65) Prior Publication Data

US 2008/0066347 A1 Mar. 20, 2008

(30) Foreign Application Priority Data

Jul. 14, 2004 (JP) ..... 2004-004162
Aug. 6, 2004 (JP) ..... 2004-004727

(51) Int. Cl.

| | |
|---|---|
| ***B32B 5/08*** | (2006.01) |
| ***B32B 27/12*** | (2006.01) |
| ***D04H 11/04*** | (2006.01) |
| ***A43B 13/00*** | (2006.01) |
| ***A43B 13/12*** | (2006.01) |

(52) U.S. Cl. ..... 428/95; 428/92; 442/268; 442/269; 442/319; 36/28; 36/30 R; 36/43; 36/44; 36/83

(58) Field of Classification Search ..... None
See application file for complete search history.

(56) References Cited

U.S. PATENT DOCUMENTS 7,387,976 B2 * 6/2008 Baba et al. ..... 442/268

(Continued)

FOREIGN PATENT DOCUMENTS

JP 3066533 U 6/1991

(Continued)

OTHER PUBLICATIONS

Microfilm of the Specification and Drawings Annexed to the Request of Japanese Utility Model Application No. 31440/1980 (Laid-Open No. 134389/1981) (Kabushiki Kaisha Fukokueata), Oct. 12, 1981.

(Continued)

*Primary Examiner*—Jennifer A Chriss
(74) *Attorney, Agent, or Firm*—Sughrue Mion, PLLC

(57) ABSTRACT

A web comprising a matrix fiber containing a non-elastic polyester based short fiber and an elastic composite fiber which is made of a thermoplastic elastomer having a melting point of at least 40° C. lower than a melting point of a polyester polymer constituting the short fiber and a non-elastic polyester, with the former being at least exposed on a surface of the fiber, and optionally a hygroscopic and exothermic fiber is heat molded such that the fibers are aligned in a thickness direction thereof, thereby obtaining a mat layer, onto which is then stuck a surface skin material to form an internal material of shoe, and a shoe insole and a boot are obtained by using the internal material of shoe.

20 Claims, 2 Drawing Sheets

U.S. PATENT DOCUMENTS

2003/0153230 A1 * 8/2003 Chen ..... 442/381

FOREIGN PATENT DOCUMENTS

| | | | |
|---|---|---|---|
| JP | 6-141901 | | 5/1994 |
| JP | 8-182506 | A | 7/1996 |
| JP | 9-28410 | A | 2/1997 |
| JP | 2000-265365 | | 1/2000 |
| JP | 2001-112578 | | 4/2001 |
| JP | 2003-105657 | | 4/2003 |

OTHER PUBLICATIONS

Microfilm of the Specification and Drawings Annexed to the Request of Japanese Utility Model Application No. 104782/1989 (Laid-Open No. 43830/1991) (Takashi Sumiie), Apr. 24, 1991.

* cited by examiner

INTERNAL MATERIAL OF SOLE, SHOE INSOLE AND BOOT

TECHNICAL FIELD

The present invention relates to an internal material of shoe which is used as an internal material in the inside of a shoe, a shoe insole which is configured of the internal material of shoe and a boot having the internal material of shoe aligned in the inside thereof. In particular, the invention relates to an internal material of shoe, a shoe insole and a boot having excellent lightweight properties, cushioning properties and air permeability.

BACKGROUND ART

As an internal material which is used as an internal material in the inside of a shoe, for example, there have hitherto been known materials resulting from sticking a canvas onto wool and materials mainly composed of polyurethane foam (see, for example, Patent Documents 1 and 2). However, when a shoe insole is configured of such an internal material of shoe, there was involved such a problem that in using the shoe insole, the weight is heavy and the air permeability is so bad that a stuffy feeling is produced. Also, in materials using a natural fiber such as wool, there was involved such a problem that when washed with water, the cushioning properties are lowered.

For that reason, there have been demanded proposals of an internal material of shoe having excellent lightweight properties, cushioning properties and air permeability. Also, there have been demanded proposals of an internal material of shoe also having heat retaining properties to be used in the winter season or low-temperature environment.

Incidentally, as fiber products having heat retaining properties, there have hitherto been proposed a material using an acrylate based hygroscopic and exothermic fiber (see, for example, Patent Documents 3 and 4), an internal material of shoe having a hygroscopic and exothermic organic fine particle attached thereto (see, for example, Patent Document 5).

[Patent Document 1] Registered Utility Model No. 3066533

[Patent Document 2] JP-A-6-14190

[Patent Document 3] JP-A-2000-265365

[Patent Document 4] JP-A-2001-112578

[Patent Document 5] JP-A-2003-105657

DISCLOSURE OF THE INVENTION

An object of the invention is to provide an internal material of shoe, a shoe insole and a boot having excellent lightweight properties, cushioning properties and air permeability. The foregoing object can be achieved by an internal material of shoe, a shoe insole and a boot of the invention.

The internal material of shoe of the invention is an internal material of shoe having a textile surface skin stacked and stuck onto a mat layer, which is characterized in:

that the mat layer comprises a matrix fiber containing a non-elastic polyester based short fiber and an elastic composite fiber which is made of a thermoplastic elastomer having a melting point of at least 40° C. lower than a melting point of a polyester polymer constituting the short fiber and a non-elastic polyester, with the former being at least exposed on a surface of the fiber;

that at least a part of a contact point between the elastic composite fibers and/or a contact point between the elastic composite fiber and the matrix fiber is heat adhered; and that the matrix fiber and the elastic composite fiber are aligned in a thickness direction of the mat layer.

Here, it is preferable that the matrix fiber is a hollow fiber. Furthermore, it is preferable that the matrix fiber comprises a fiber capable of generating heat upon absorption of moisture in an amount of from 10 to 80% by weight based on the weight of the mat layer. Furthermore, it is preferable that the matrix fiber contains a highly water absorbing and hygroscopic fiber in an amount of from 10 to 80% by weight based on the weight of the mat layer. It is preferable that such a mat layer has a thickness falling within the range of from 2 to 10 mm. Furthermore, it is preferable that the mat layer has a basis weight falling within the range of from 200 to 1,500 g/m$^2$.

In the internal material of shoe of the invention, it is preferable that the surface skin comprises a polyester fiber. In addition, it is preferable that the surface skin contains a fiber capable of generating heat upon absorption of moisture in an amount of 20% by weight or more based on the weight of the surface skin. On that occasion, it is preferable that the fiber capable of generating heat upon absorption of moisture is an acrylate based hygroscopic and exothermic fiber. Furthermore, it is preferable that the surface skin is a knit fabric. Furthermore, it is preferable that in the mat layer, a surface thereof on which the surface skin is stacked is a sliced cut surface.

The shoe insole of the invention is a shoe insole which is configured of the foregoing internal material of shoe. Furthermore, the boot of the invention is a boot having the foregoing internal material of shoe disposed in the inside thereof.

BEST MODES FOR CARRYING OUT THE INVENTION

Figure 3:
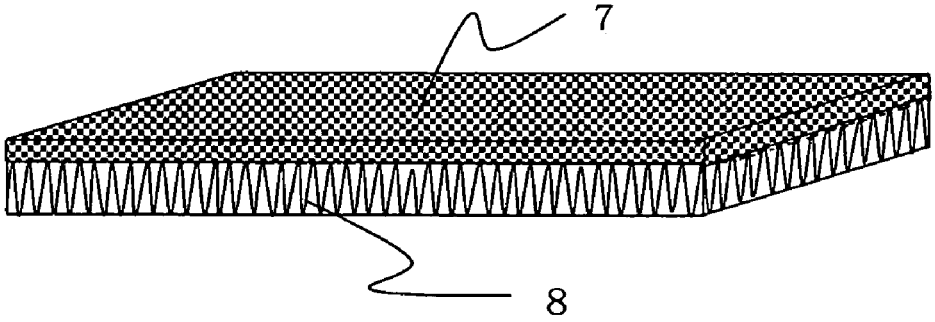
FIG. 3 is a view to schematically show an internal material of shoe according to the invention, in which the numeral 7 designates a surface skin; and 8 designates a mat layer.

As schematically illustrated in FIG. 3, the internal material of shoe of the invention is an internal material of shoe having a textile surface skin stacked and stuck onto a mat layer as described layer. Incidentally, the surface skin may be stacked onto only one face of the mat layer or may be stacked onto both faces thereof.

The mat layer comprises a matrix fiber containing a non-elastic polyester based short fiber and an elastic composite fiber which is made of a thermoplastic elastomer having a melting point of at least 40° C. lower than a melting point of a polyester polymer constituting the short fiber and a non-elastic polyester, with the former being at least exposed on a surface of the fiber; at least a part of a contact point between the elastic composite fibers and/or a contact point between the elastic composite fiber and the matrix fiber is heat adhered; and the matrix fiber and the elastic composite fiber are aligned in a thickness direction of the mat layer.

Here, as the non-elastic polyester based short fiber, there are enumerated usual short fibers made of, for example, polyethylene terephthalate, polybutylene terephthalate, polytrimethylene terephthalate, polyhexamethylene terephthalate, poly-1,4-dimethylcyclohexane terephthalate, polypivalolactone, or a copolymer thereof. Of these, short fibers made of polyethylene terephthalate, polybutylene terephthalate or polytrimethylene terephthalate are preferable. A polymer constituting such a fiber may be compounded with various stabilizers, ultraviolet absorbers, thickening and branching agents, delustering agents, colorants, and other various modifiers as the need arises.

A sectional shape of the short fiber may be any of a usual round, flat, deformed or hollow shape. However, in view of designing to obtain excellent lightweight properties, it is preferable that the sectional shape is hollow in a hollowness rate of from 15 to 60%. In addition, a composite fiber resulting from joining two kinds of polyester components having a different intrinsic viscosity from each other in a side-by-side form or an eccentric core/sheath form may be employed.

It is preferable that zigzag crimps are given to such a non-elastic polyester based short fiber by a spiral crimping method by anisotropic cooling or a stuffing crimping method so as to have the number of crimp of from 3 to 40 per 25 mm (more preferably from 7 to 15 per 25 mm). In the case where the number of crimp is less than 3 per 25 mm, interlacing between the short fibers is insufficient so that card passing properties become worse, resulting in a possibility that a high-grade mat layer is not obtained. On the other hand, in the case where the number of crimp exceeds 40 per 25 mm, interlacing of the short fibers become too large so that sufficient carding by a card cannot be achieved, resulting in a possibility that a high-grade mat layer is not obtained.

With respect to single yarn fineness and fiber length of the non-elastic polyester based short fiber, in view of obtaining excellent cushioning properties, it is preferable that the single yarn fineness falls within the range of from 2 to 20 dtex and that the fiber length falls within the range of from 20 to 100 mm.

Though the matrix fiber may be constituted of only the non-elastic polyester based short fiber, the matrix fiber may contain, in addition to the non-elastic polyester based short fiber, a fiber capable of generating heat upon absorption of moisture (hereinafter sometimes referred to as "hygroscopic and exothermic fiber"). On that occasion, examples of the fiber capable of generating heat upon absorption of moisture include acrylate based hygroscopic and exothermic fibers (for example, a trade name "PRESSTHERMO" (N-38) and a trade name "EKS" (G-800) of Toyobo Co., Ltd. and a trade name "SUNBURNER" of Toho Textile Co., Ltd.). As described in JP-A-2001-112578, this acrylate based hygroscopic and exothermic fiber is a fiber in which a fiber formed of an acrylonitrile based polymer containing 40% by weight or more of acrylonitrile is used as a starting material and a hydrazine based compound is introduced as a crosslinking agent. It is preferable that such a hygroscopic and exothermic fiber is also a short fiber having the same single yarn fineness, fiber length and crimps as the foregoing non-elastic polyester based short fiber.

In addition, the matrix fiber may contain a highly water absorbing and hygroscopic fiber. On that occasion, the "highly water absorbing and hygroscopic fiber" as referred to herein is a highly water absorbing and hygroscopic fiber having a difference ($R_2-R_1$) between a coefficient of moisture absorption ($R_1$) at 20° C. and 60% RH and a coefficient of moisture absorption ($R_2$) at 20° C. and 97% RH of 30% or more and an amount of water absorption per fiber unit of 300% by weight or more and not more than 8,000% by weight. Examples thereof include crosslinked acrylate based fibers, fibers obtainable from hydrolysis of a surface of an acrylic fiber by post-processing, and fibers obtainable from graft polymerization of acrylic acid or methacrylic acid on a fiber such as polyesters. These fibers may be used singly or in combination of two or more kinds thereof. As a suitable commercially available product of the crosslinked acrylate based fiber, there can be enumerated "BELL OASIS" manufactured by Teijin Fibers Limited, "N38" manufactured by Toyobo Co., Ltd, and etc.

Furthermore, as the foregoing elastic composite fiber, an elastic composite fiber which is made of a thermoplastic elastomer having a melting point of at least 40° C. lower than a melting point of a polyester polymer forming the elastic polyester based fiber and a non-elastic polyester, with the former (thermoplastic elastomer) being at least exposed on a surface of the fiber can be used. On that occasion, it is preferable that the former accounts for at least ½ of the surface of the fiber. A weight proportion of the former to the latter is suitably in the range of from 30/70 to 70/30. Though a composite form of the elastic composite fiber may be any of a side-by-side type or a core/sheath type, the latter is preferable. In this core/sheath type, though the non-elastic polyester polymer constitutes a core part, this core part may be in a concentric circle form or an eccentric form. In particular, the core part in a eccentric form is preferable because spiral crimping is revealed. Incidentally, a sectional shape of the composite fiber may be any of a hollow, solid or deformed shape.

As the thermoplastic elastomer, there can be enumerated polyurethane based elastomers and polyester based elastomers.

Examples of the polyurethane based elastomer include polymers obtained by reacting a low melting polyol having a molecular weight of from about 500 to 6,000, for example, dihydroxy polyether, dihydroxy polyester, dihydroxy polycarbonate, and dihydroxy polyester amide; an organic diisocyanate having a molecular weight of not more than 500, for example, p,p'-diphenylmethane diisocyanate, tolylene diisocyanate, isophorone diisocyanate, hydrogenated diphenylmethane diisocyanate, xylyene isocyanate, 2,6-diisocyanate methyl caproate, and hexamethylene diisocyanate; and a chain extender having a molecular weight of not more than 500, for example, glycol amino alcohol and triols.

Of these polymers, polyurethanes using, as the polyol, polytetramethylene glycol, poly-ϵ-caprolactam or polybutylene adipate are especially preferable. In this case, as the organic diisocyanate, p,p'-bishydroxyethoxybenzene and 1,4-butanediol can be enumerated.

Furthermore, as the polyester based elastomer, polyether ester copolymers resulting from copolymerization of a thermoplastic polyester as a hard segment and a poly (alkylene oxide) glycol as a soft segment can be enumerated. More specifically, there can be enumerated terpolymers which are constituted of at least one dicarboxylic acid selected from alicyclic dicarboxylic acids, for example, terephthalic acid, isophthalic acid, phthalic acid, naphthalene-2,6-dicarboxylic acid, naphthalene-2,7-dicarboxylic acid, diphenyl-4,4'-dicarboxylic acid, and 1,4-cyclohexanedicarboxylic acid, aliphatic dicarboxylic acids, for example, succinic acid, oxalic acid, adipic acid, sebacic acid, dodecane diacid, and dimeric acid, ester forming derivatives thereof, and so on; at least one diol component selected from aliphatic diols, for example, 1,4-butanediol, ethylene glycol, trimethylene glycol, tetramethylene glycol, pentamethylene glycol, hexamethylene glycol, neopentyl glycol, and decamethylene glycol, alicyclic diols, for example, 1,1-cyclohexanedimethanol, 1,4-cyclohexanedimethanol, and tricyclodecanemethanol, ester forming derivatives thereof, and so on; and at least one poly(alkylene oxide) glycol having from about 400 to 5,000, for example, polyethylene glycol, poly(1,2- or 1,3-polypropxylene oxide) glycol, poly(tetramethylene oxide) glycol, a copolymer of ethylene oxide and propylene oxide, and a copolymer of ethylene oxide and tetrahydrofuran.

In view of adhesion, temperature characteristic and strength, block copolymerization polyether esters which are made of polybutylene based terephthalate as a hard component and polyoxybutylene glycol as a soft segment are especially preferable.

In this case, the polyester portion constituting the hard segment is polybutylene terephthalate in which a principal acid component thereof is terephthalic acid and a principal diol component thereof is a butylene glycol component. As a matter of course, a part (usually not more than 30% by mole) of this acid component may be substituted with other dicarboxylic acid component or hydroxycarboxylic acid component. Similarly, a part (usually not more than 30% by mole) of the glycol component may be substituted with a dihydroxy component other than the butylene glycol component. Furthermore, the polyether portion constituting the soft segment may be a polyether which is substituted with a dioxy component other than butylene glycol.

Examples of the non-elastic polyester which is a counterpart component to the foregoing thermoplastic elastomer include polyesters, for example, polyethylene terephthalate, polybutylene terephthalate, and polytrimethylene terephthalate.

The polymer constituting such an elastic composite fiber may be compounded with various stabilizers, ultraviolet absorbers, thickening and branching agents, delustering agents, colorants, and other various modifiers as the need arises.

Furthermore, in general, a sectional shape of the elastic composite fiber may be any of a usual round, flat, deformed or hollow shape. Though with respect to a fiber form, the composite fiber may be any of a short fiber or a long fiber, in view of obtaining excellent cushioning properties, it is preferable that the composite fiber is a short fiber having a single yarn fineness falling within the range of from 2 to 20 dtex and a fiber length falling within the range of from 20 to 100 mm.

The mat layer comprises a matrix fiber containing the non-elastic polyester based short fiber and the elastic composite fiber. On that occasion, the matrix fiber may also contain the foregoing hygroscopic and exothermic fiber or highly water absorbing and hygroscopic fiber. On that occasion, it is preferable that the weight of the hygroscopic and exothermic fiber or highly water absorbing and hygroscopic fiber falls within the range of from 10 to 80% by weight based on the weight of the respective mat layer.

It is preferable that a mixing ratio of the matrix fiber and the elastic composite fiber to be contained in the mat layer is in the range of from 90/10 to 10/90 in terms of a weight ratio of the former to the latter. When the weight ratio of the elastic composite fiber is smaller than 10%, the number of heat adhesive points sufficient for producing the mat layer is not obtained, resulting in a possibility that laundry durability is lowered. Conversely, when the weight ratio of the elastic composite fiber exceeds 90%, the number of heat adhesive points for producing the mat layer excessively increases, resulting in a possibility that the internal material of shoe becomes coarse and rigid.

It is preferable that a density of the mat layer is from 0.01 to 0.12 g/cm$^3$.

Figure 1:
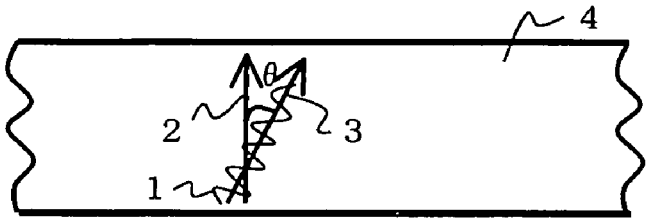
FIG. 1 is an explanatory view to explain a direction of alignment of a matrix fiber or elastic composite fiber in a mat layer, in which the numeral 1 designates a matrix fiber or elastic composite fiber; 2 designates a thickness direction of the mat layer; 3 designates an alignment direction of the matrix fiber or elastic composite fiber; and 4 designates a mat layer.

Furthermore, in the mat layer, it is important that at least a part of a contact point between the elastic composite fibers and/or a contact point between the elastic composite fiber and the matrix fiber is heat adhered and that the matrix fiber and the elastic composite fiber are aligned in a thickness direction of the mat layer. Here, it is meant by the terms "the matrix fiber and the elastic composite fiber are aligned in a thickness direction" as referred to in the invention that when the mat layer is cut in a thickness direction thereof, and in its cross section, a total number of the matrix fiber and the elastic composite fiber as disposed in parallel to the thickness direction ($0° \leqq \theta \leqq 45°$ in FIG. 1) is defined as T and a total number of the matrix fiber and the elastic composite fiber as disposed vertical to the thickness direction ($45° < \theta \leqq 90°$ in FIG. 1) is defined as W, T/W is 1.5 or more.

In order to align the matrix fiber and the elastic composite fiber in the thickness direction of the mat layer in this way, such can be easily-achieved by a method as described in JP-T-2002-516932. That is, the elastic composite fiber and the matrix fiber are first blended through a card such that when the total number of fibers going toward the longitudinal direction is defined as A and the total number of fibers going toward the transverse direction is defined is B, A is larger than 3B/2, thereby obtaining a continuous web; and the web is subsequently thrust into a hot air suction system dryer set up at a temperature of a melting point of the foregoing thermoplastic elastomer or higher by a drive roll by using a device as described in JP-T-2002-516932 (Struto equipment as manufactured by Struto International, Inc. as one of the device available in the market) and folded in an accordion form. By such a method, not only the matrix fiber and the elastic composite fiber can be aligned in the thickness direction of the mat layer, but also the elastic composite fibers and/or the elastic composite fiber and the matrix fiber can be heat adhered, whereby a flexible heat fixing point can be formed.

In the internal material of shoe of the invention, though a fiber constituting the surface skin is not particularly limited, a polyester fiber made of a polyester the same as in the foregoing matrix fiber is preferable in view of recycle properties. Such a polyester fiber may be a long fiber and may be a false-twist crimped textured yarn. Furthermore, what the surface skin contains the foregoing hygroscopic and exothermic fiber in an amount of 20% by weight or more (preferably from 30 to 80% by weight) based on the weight of the surface skin is preferable because excellent heat retaining properties are obtained. When the content of the hygroscopic and exothermic fiber is less than 20% by weight, there is a possibility that sufficient heat retaining properties are not obtained.

Though the construction of the surface skin may be any of a knit fabric, a woven fabric or a non-woven fabric, in view of obtaining excellent air permeability, it is preferable that the surface skin is made of a knit fabric, for example, a moss stitch fabric and a circular rib fabric. It is preferable that a basis weight of such a surface skin falls within the range of from 100 to 400 g/m$^2$.

The internal material of shoe of the invention is prepared by stacking and sticking the surface skin onto the mat layer. On that occasion, in the mat layer, when a surface thereof on which the surface skin is stacked is a sliced cut surface, since the surface skin is stuck onto the flat cut surface of the mat layer, the surface of the resulting internal material of shoe becomes also flat and the appearance becomes well and therefore, such is preferable. Furthermore, since in the flat cut surface of the mat layer, an end part of the fiber constituting the mat layer appears on the surface, friction between the fiber contained in the mat layer and an adhesive layer increases so that sticking of the surface skin becomes easy, and therefore, such is preferable.

An adhesion method between the mat layer and the surface skin is not particularly limited, and a known method can be employed. For example, a method of cutting a textile and a mat layer in a shoe insole state by a cutting machine, applying an adhesive onto the textile to stick to the mat layer and setting and heat molding the stack in a molding machine is employable. On that occasion, a non-woven heat adhesive sheet (for example, "SPUNFAB" (registered trademark) manufactured by Nitto Boseki Co., Ltd.) may be used in place of the adhesive. Furthermore, sticking of the textile may be achieved at the same time with the preparation of a mat layer. Incidentally, the resulting sheet may be cut in a footprint as it is, or may be formed in a molded article by using a mold. As a molding method, any of gold molding or hot molding is employable.

In addition, the same raw material as in the surface skin may be adhered on a back face of the mat layer in the same sticking method as the need arises.

In the thus obtained internal material of shoe, in view of obtaining excellent cushioning properties and lightweight properties, it is preferable that a thickness of the mat layer falls within the range of from 2 to 15 mm. Furthermore, it is preferable that a basis weight of the mat layer falls within the range of from 200 to 1,500 g/m$^2$.

In the internal material of shoe of the invention, since the matrix fiber and the elastic composite fiber as contained in the mat layer are aligned in a thickness direction of the mat layer, the internal material of shoe of the invention has lightweight and cushioning properties and has excellent air permeability so that it is free from a stuffy feeling. Furthermore, in the case where the hygroscopic and exothermic fiber is contained in the mat layer and/or the surface skin, excellent heat retaining properties are obtained.

Incidentally, in the internal material of shoe of the invention, the mat layer may be of a single-layered structure or may be a multilayered structure of two or more layers. Furthermore, the mat layer may have a back face layer. In addition, known usual processing, for example, alkali reduction processing, dyeing finish processing, calendar processing, resin coating, film lamination, antibacterial and deodorizing processing, and minus ion generation processing may be properly added.

Figure 4:
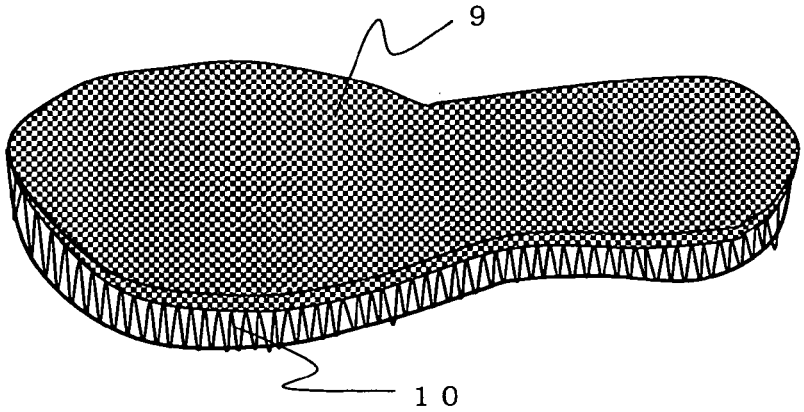
FIG. 4 is a view to schematically show a shoe insole according to the invention, in which the numeral 9 designates a surface skin; and 10 designates a mat layer.

Next, according to the invention, a shoe insole which is configured of the foregoing internal material of shoe is provided. Such a shoe insole has a shape as schematically illustrated in FIG. 4 and has lightweight and cushioning properties and is free from a stuffy feeling.

Figure 5:
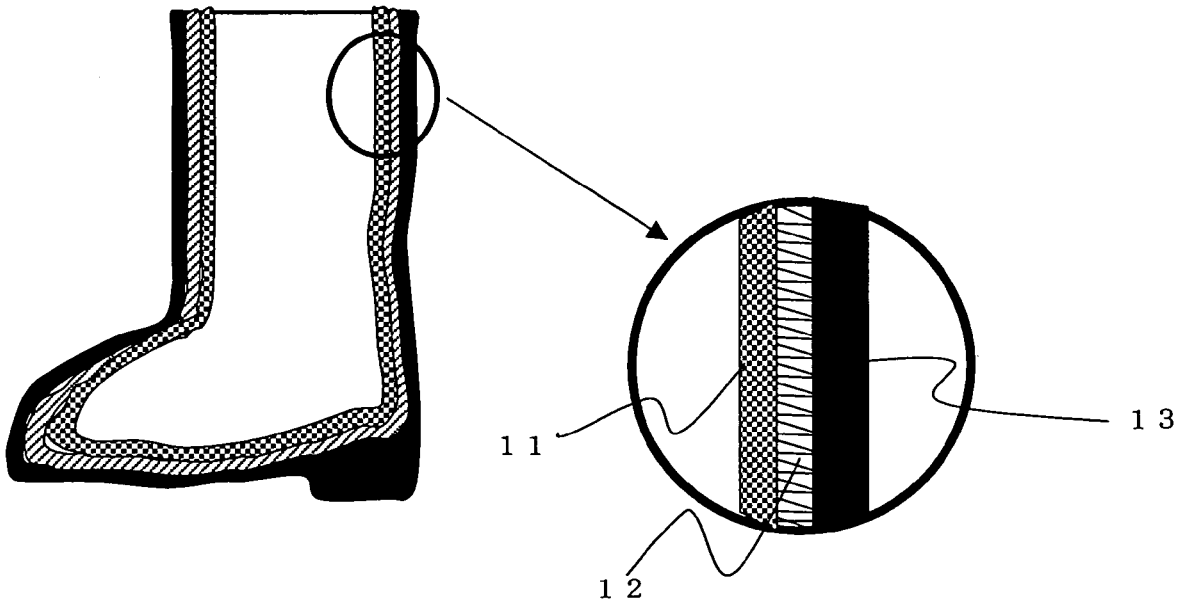
FIG. 5 is a view to schematically show a boot according to the invention, in which the numeral 11 designates a surface skin; 12 designates a mat layer; and 13 stands for a rubber layer.

In addition, according to the invention, a boot having the foregoing internal material of shoe disposed in the inside thereof is provided. Such a boot has a shape as schematically illustrated in FIG. 5 and has lightweight and cushioning properties and is free from a stuffy feeling.

EXAMPLES

Next, Examples and Comparative Example of the invention will be hereunder described in detail, but it should not be construed that the invention is limited thereto. Incidentally, the respective measurement items in the Examples were measured in the following methods.

(1) Melting Point:

The measurement was carried out at a temperature rise rate of 20° C./min by using a thermal differential analyzer Model 990 manufactured by Du Pont, thereby determining a melting peak. In the case where a melting temperature is not definitely measured, a temperature at which a polymer is softened to start fluidization (softening point) is measured by using a micro melting point meter (manufactured by Yanagimoto Mfg. Co., Ltd.) is employed as the melting point. Incidentally, an average value thereof was determined at the n number of 5.

(2) Number of Crimp:

The number of crimp per 25 mm was counted according to a method as described in JIS L 1015 7.12.1. Incidentally, an average value thereof was determined at the n number of 5.

(3) Density:

The density was measured according to JIS K 6401. That is, a weight of a specimen was divided by a volume of the specimen, and the resulting value was defined as the density.

(4) Air Permeability:

The air permeability was measured according to a JIS L 1096 6.27.1A method by using a Frazier type tester.

(5) T/W:

A mat layer was cut in a thickness direction thereof; and in its cross section, a total number of a matrix fiber and an elastic composite fiber as disposed in parallel to the thickness direction ($0° \leqq \theta \leqq 45°$ in FIG. 1) was defined as T and a total number of a matrix fiber and an elastic composite fiber as disposed vertical to the thickness direction ($45° < \theta \leqq 90°$ in FIG. 1) was defined as W, thereby calculating T/W. Incidentally, with respect to the measurement of the number, respective 30 fibers in arbitrary 10 places were observed by a transmission optical microscope, and the number was counted.

Example 1

38% (by weight) of polybutylene based terephthalate obtained by polymerizing an acid component resulting from mixing terephthalic acid and isophthalic acid in a ratio of 80/20 (% by mole) and butylene glycol was further reacted under heating with 62% (by weight) of polybutylene terephthalate (molecular weight: 2,000), thereby obtaining a thermoplastic block copolymerization polyether ester elastomer. This thermoplastic elastomer had an intrinsic viscosity of 1.0, a melting point of 155° C., an elongation at break of film of 1,500%, a 300% stretch stress of 2.94 Pa (0.3 kg/mm$^2$), and a 300% stretch recovery of 75%. By using this thermoplastic elastomer as a sheath part and usual polybutylene terephthalate (melting point: 230° C.) as a core part, an elastic composite fiber yarn was spun in a usually method such that a weight ratio of the core part to the sheath part was 60/40. This elastic composite fiber yarn is an eccentric core/sheath type composite fiber. This elastic composite fiber yarn was stretched about twice, to which was then imparted a surface treating agent (lubricant). Thereafter, the resulting composite fiber yarn was cut into 51 mm to obtain an elastic composite fiber having a single yarn fineness of 6.6 dtex.

On the other hand, polyethylene terephthalate (melting point: 256° C.) having an intrinsic viscosity of 0.65 was spun, to which were then imparted three-dimensional crimps (number of crimp: 12 per 25 mm) by anisotropic cooling. Thereafter, the resulting yarn was cut into 64 mm, thereby obtaining a hollow polyethylene terephthalate short fiber having a single yarn fineness of 13.3 dtex (matrix fiber, melting point: 256° C., hollowness rate: 30%)

Figure 2:
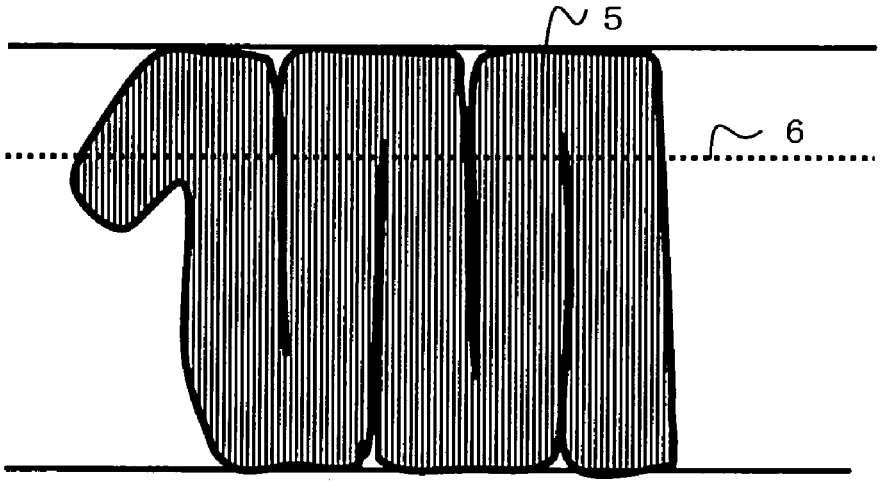
FIG. 2 is a view to schematically show a state that a web is folded in a pleated form, thereby aligning the major part of the fibers in a thickness direction thereof, in which the numeral 5 designates a mountain of the web; and 6 designates a surface to be sliced.

Subsequently, 50% (by weight) of the elastic composite fiber and 50% (by weight) of the hollow polyethylene terephthalate short fiber were blended; the blend was passed successively through a roller card, a cross lay and a roller card; subsequently, by using Struto equipment manufactured by Struto International, Inc., the web was folded in a pleated form as illustrated in FIG. 2, thereby aligning the major part of the fibers in a thickness direction; and the fibers were then subjected to a heat adhesion treatment in a heat treat furnace at a temperature of 200° C., thereby obtaining a mat layer (T/W=4.8, basis weight: 480 g/m$^2$, thickness: 12 mm, density: 0.04 g/cm$^3$).

On the other hand, a usual polyethylene terephthalate multifilament false-twist crimped textured yarn (100 dtex/48 fil) was used to obtain a moss stitch fabric having a basis weight of 200 g/m$^2$ as a surface skin.

Subsequently, by interposing SPUNFAB (registered trademark) manufactured by Nitto Boseki Co., Ltd. between the mat layer and the surface skin and using a plate-like mold, an internal material of shoe having a thickness of 7 mm was heat molded.

As a result of measuring the material quality, the resulting sheet had cushioning properties of 740 N and an air permeability of 95 cc/cm$^2$·sec and therefore, was excellent in not only lightweight properties but also cushioning properties and air permeability. In addition, when soiled, the internal material of shoe could be washed with water.

Such an internal material of shoe was cut into a shape as illustrated in FIG. 4, thereby preparing a shoe insole. Furthermore, by using such an internal material of shoe, a boot as illustrated in FIG. 5 was prepared.

Example 2

An internal material of shoe was heat molded in the same manner as in Example 1, except that in Example 1, prior to sticking the surface skin onto the mat layer, the surface of the mat layer in the sticking side was sliced by 3 mm in a thickness so as to have a thickness of 9 mm. As a result, sticking of the surface skin was easy. Furthermore, in the resulting internal material of shoe, the surface of the surface skin was flat.

Example 3

A mat layer (T/W=4.1, basis weight: 525 g/m$^2$, thickness: 15 mm, density: 0.035 g/cm$^3$) was obtained in the same manner as in Example 1, except that in Example 1, 30% (by weight) of the same elastic composite fiber as in Example 1, 50% (by weight) of the same hollow polyethylene terephthalate short fiber as in Example 1, and 20% (by weight) of a hygroscopic and exothermic fiber (SUNBURNER, trade name, manufactured by Toho Textile Co., Ltd.) were blended. Subsequently, a central part thereof was sliced to form two sheets.

On the other hand, 20/1 of a hygroscopic and exothermic fiber (SUNBURNER, trade name, manufactured by Toho Textile Co., Ltd.) and a usual polyethylene terephthalate multifilament yarn (84 dtex/48 fil) were interknitted at a weight ratio of the former to the latter of 30 to 70, thereby forming a knit fabric (basis weight: 230 g/m$^2$).

Subsequently, such a knit fabric was stuck onto the sliced surface of the mat layer in the same manner as in Example 1, thereby obtaining an internal material of shoe having a thickness of 5 mm.

The resulting sheet had cushioning properties of 570 N and an air permeability of 120 cc/cm$^2$·sec and therefore, was excellent in lightweight properties, cushioning properties and air permeability. In addition, it was excellent in heat retaining properties.

Such an internal material of shoe was cut into a shape as illustrated in FIG. 4, thereby preparing a shoe insole. Furthermore, by using such an internal material of shoe, a boot as illustrated in FIG. 5 was prepared.

Example 4

A shoe insole material was prepared in the same manner as in Example 1, except that in Example 1, 40% (by weight) of the same elastic composite fiber as in Example 1, 50% (by weight) of the same hollow polyethylene terephthalate short fiber as in Example 1, and 10% (by weight) of a highly water absorbing and hygroscopic fiber (BELL OASIS, trade name, manufactured by Teijin Fibers Limited) were blended. This shoe insole was used in a sports shoe, and the movement was carried out for a while. As a result, there was brought a very comfortable feeling without producing a stuffy feeling. Furthermore, the cushioning properties were well.

Comparative Example 1

A mat layer (T/W=0.1, basis weight: 500 g/m$^2$, thickness: 10 mm, density: 0.05 g/cm$^3$) was obtained in the same manner as in Example 1, except that in Example 1, the fibers were not aligned in the thickness direction in obtaining the mat layer. Thereafter, an internal material of shoe was obtained in the same manner as Example 1.

The resulting internal material of shoe had cushioning properties of 650 N and an air permeability of 50 cc/cm$^2$·sec. Thought this internal material of shoe had cushioning properties comparable to the internal material of shoe of Example 1, it was not comfortable to wear. Furthermore, it was inferior in air permeability.

INDUSTRIAL APPLICABILITY

According to the invention, an internal material of shoe, a shoe insole and a boot having excellent lightweight properties, cushioning properties and air permeability are obtained so that its industrial value is extremely large.

The invention claimed is:

1. An internal material of shoe comprising a mat layer and a textile surface skin which is stuck to said mat layer, wherein the mat layer comprises a matrix fiber containing a non-elastic polyester based short fiber and an elastic composite fiber which is made of a thermoplastic elastomer having a melting point of at least 40° C. lower than a melting point of a polyester polymer constituting the short fiber and a non-elastic polyester, with the former being at least exposed on a surface of the fiber;

at least a part of a contact point between the elastic composite fibers and/or a contact point between the elastic composite fiber and the matrix fiber is heat adhered; and the matrix fiber and the elastic composite fiber are aligned in a thickness direction of the mat layer.

2. The internal material of shoe according to claim 1, wherein the matrix fiber is a hollow fiber.

3. The internal material of shoe according to claim 1, wherein the matrix fiber contains a fiber capable of generating heat upon absorption of moisture in an amount ranging from 10 to 80% by weight based on the weight of the mat layer.

4. The internal material of shoe according to claim 1, wherein the matrix fiber contains a highly water absorbing and hygroscopic fiber in an amount ranging from 10 to 80% by weight based on the weight of the mat layer.

5. The internal material of shoe according to claim 1, wherein the mat layer has a thickness of 2 to 10 mm.

6. The internal material of shoe according to claim 1, wherein the mat layer has a basis weight of 200 to 1,500 g/$m^2$.

7. The internal material of shoe according to claim 1, wherein the surface skin comprises a polyester fiber.

8. The internal material of shoe according to claim 7, wherein the surface skin further comprises a fiber capable of generating heat upon absorption of moisture in an amount of 20% by weight or more based on the weight of the surface skin.

9. The internal material of shoe according to claim 8, wherein the fiber capable of generating heat upon absorption of moisture is an acrylate based hygroscopic and exothermic fiber.

10. The internal material of shoe according to claim 1, wherein the surface skin is a knit fabric.

11. The internal material of shoe according to claim 1, wherein a surface of the mat layer to which the surface skin is stuck is a sliced cut surface.

12. A shoe insole comprising the internal material of shoe according to claim 1.

13. A boot having the internal material of shoe according to claim 1 disposed in the inside thereof.

14. A shoe insole comprising the internal material of shoe according to claim 2.

15. A shoe insole comprising the internal material of shoe according to claim 3.

16. A shoe insole comprising the internal material of shoe according to claim 4.

17. A shoe insole comprising the internal material of shoe according to claim 5.

18. A shoe insole comprising the internal material of shoe according to claim 6.

19. A shoe insole comprising the internal material of shoe according to claim 7.

20. A shoe insole comprising the internal material of shoe according to claim 8.

* * * * *